US006383154B1

(12) United States Patent
Chang

(10) Patent No.: US 6,383,154 B1
(45) Date of Patent: May 7, 2002

(54) MULTI-STAGE BI-DIRECTIONAL BREATH FLOW AND BLOOD CIRCULATION AIDER

(76) Inventor: Edith Chang, No. 16-1, Lane 742, San-Feng Rd., Feng-Yuan City, Taichung Hsien (TW)

( * ) Notice: Subject to any disclaimer, the term of this patent is extended or adjusted under 35 U.S.C. 154(b) by 35 days.

(21) Appl. No.: 09/686,939

(22) Filed: Oct. 12, 2000

(51) Int. Cl.[7] ..... A61H 11/02
(52) U.S. Cl. ..... 601/145; 601/147
(58) Field of Search ..... 601/23, 33, 46, 601/67–74, 124, 143, 144, 145, 146, 147; 482/132

(56) References Cited

U.S. PATENT DOCUMENTS 1,769,569 A * 7/1930 Goodrich ..... 128/63
1,794,879 A * 3/1931 Welch ..... 128/63
1,847,048 A * 2/1932 Orr ..... 128/63
2,068,992 A * 1/1937 Larsh ..... 128/63
2,088,963 A * 8/1937 Kondo ..... 128/63
2,860,630 A * 11/1958 Christensen et al. ..... 128/63
2,980,109 A * 4/1961 Schein ..... 128/63
3,344,783 A * 10/1967 Stoll ..... 128/63
3,381,538 A * 5/1968 Runde ..... 74/87

* cited by examiner

*Primary Examiner*—Danton D. DeMille
*Assistant Examiner*—Quang Thanh
(74) *Attorney, Agent, or Firm*—Bacon & Thomas, PLLC

(57) ABSTRACT

A multi-stage bi-directional breath flow and blood circulation aider is provided with a plurality of ratchet teeth arranged in one end of a positioning seat and an adapter respectively for being meshed with each other, and the positioning seat is covered with the adapter and a closure for multi-stage control of physical energy consumption by taking advantage of an eccentric rod of the adapter. A plurality of recessed grooves is formed on the eccentric rod for arranging two fixed belts so as to commit eccentric rotation to pull and release the belts reciprocally for physical gymnastic exercise.

2 Claims, 7 Drawing Sheets

MULTI-STAGE BI-DIRECTIONAL BREATH FLOW AND BLOOD CIRCULATION AIDER

BACKGROUND OF THE INVENTION

This invention relates to a blood circulation aider, particularly it relates to a multi-stage bi-directional breath flow and blood circulation aider provided with an adjustment mechanism for regulating physical energy consumption according to individual conditions and with two pieces of fixed belt embedded in two recessed grooves respectively to allow two persons to perform exercise simultaneously.

An existing gymnastic equipment shown in FIGS. 1 and 2 mainly comprises:

a machine casing; an electric motor installed in the casing for driving a pivot shaft extending out of two end faces of the casing; a positioning seat fixed at a tail end of the pivot shaft having a shaft hole at an end face, a lateral screw hole, and a positioning hole in the other end face for anchoring an eccentric rod.

When assembling, the procedure is to:

plug the pivot shaft in the shaft hole and lock a bolt in the screw hole to prop tightly against the pivot shaft; screw the eccentric rod in the positioning hole to maintain a proper eccentricity; and collar a fixed ring onto the eccentric rod for linking and disposing a belt.

In application, a user is supposed to hitch the belt on himself, then start the motor to create eccentric rotation of the eccentric rod to further drive the belt to pull and release reciprocally for physically tempering those portions pressed by the belt, however, the eccentricity between the eccentric rod and the pivot shaft is unadjustable that fails to meet different requirements of physical energy consumption.

SUMMARY OF THE INVENTION

The primary object of this invention is to provide a multi-stage bi directional breath flow and blood circulation aider, wherein a plurality of ratchet teeth arranged in an end face of a positioning seat and of an adapter respectively are meshed with each other, and the positioning seat is covered with the adapter and a closure for multi-stage control of physical energy consumption by taking advantage of an eccentric rod of the adapter.

Another object of this invention is to provide a multi-stage bi-directional breath flow and blood circulation aider having recessed grooves on an eccentric rod for hitching two fixed belts to commit eccentric rotation for pulling and releasing the belts reciprocally.

In order to realize abovesaid objects and for pairing purpose, a plurality of ratchet teeth is formed on an end face of the positioning seat and the adapter respectively to thereby obtain a multi-stage adjustment function. In addition, the positioning seat is covered laterally with the closure and the adapter so that speed adjustment by ratchet teeth is achievable by taking advantage of propping force of a spring.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
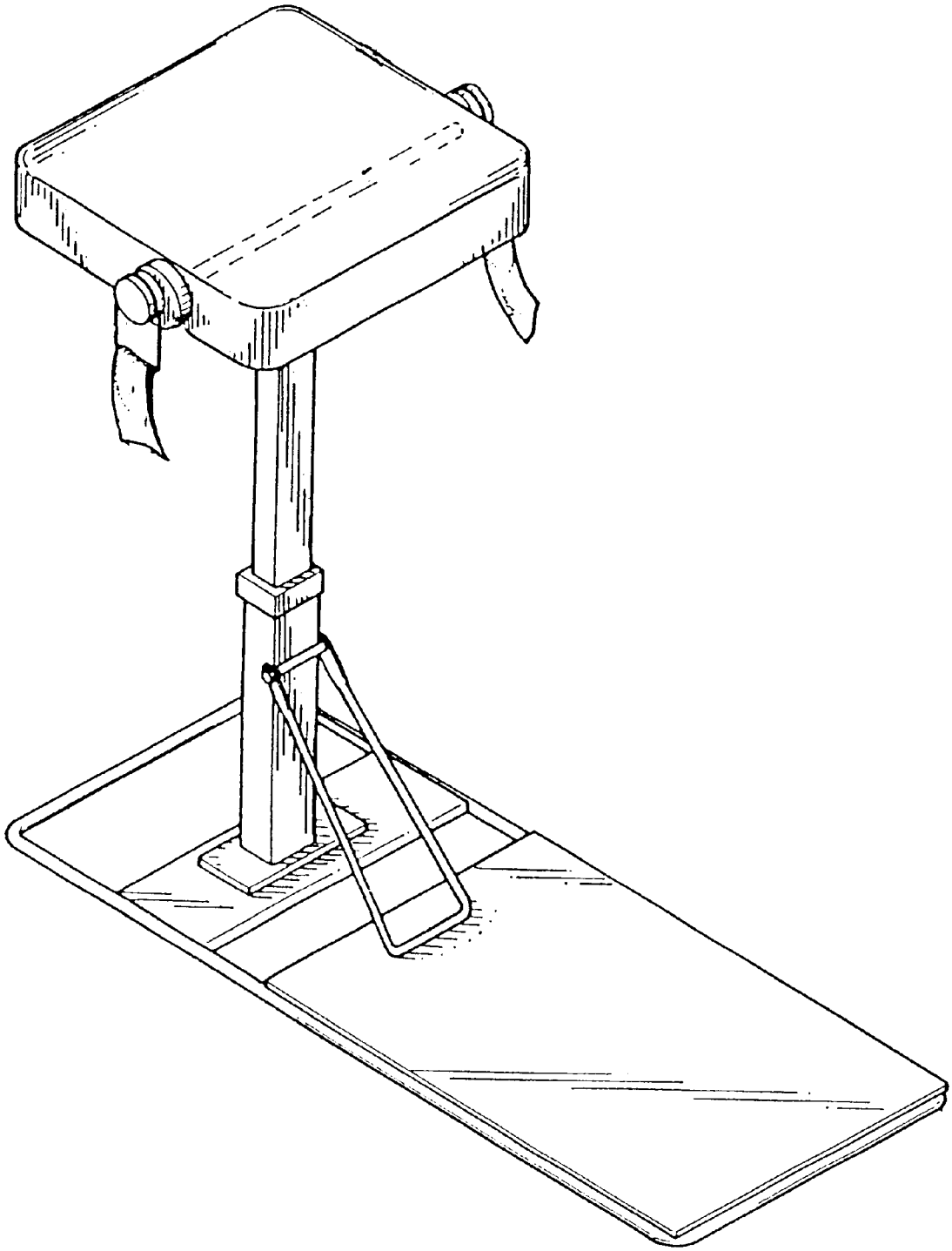
PRIOR ART Fig. 1
FIG. 1 is a schematic diagram of a conventional gymnastic equipment in three dimensions.
Figure 2:
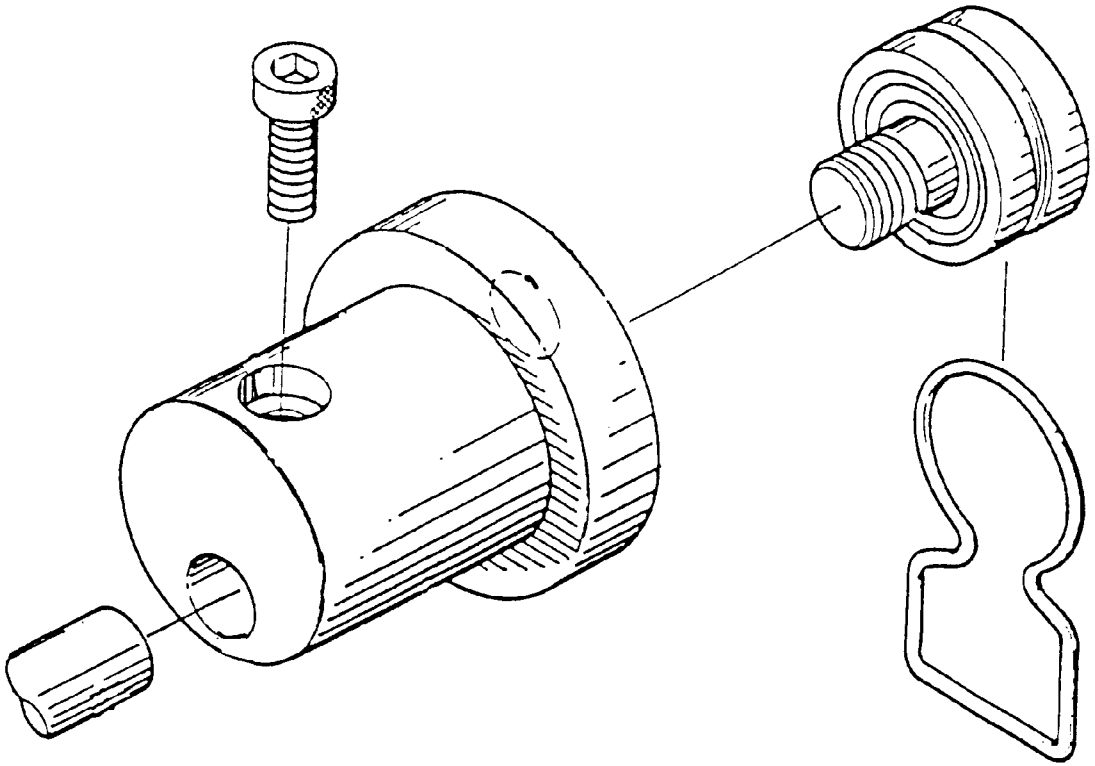
PRIOR ART Fig. 2
FIG. 2 is a partially exploded view of the conventional gymnastic equipment.
Figure 3:
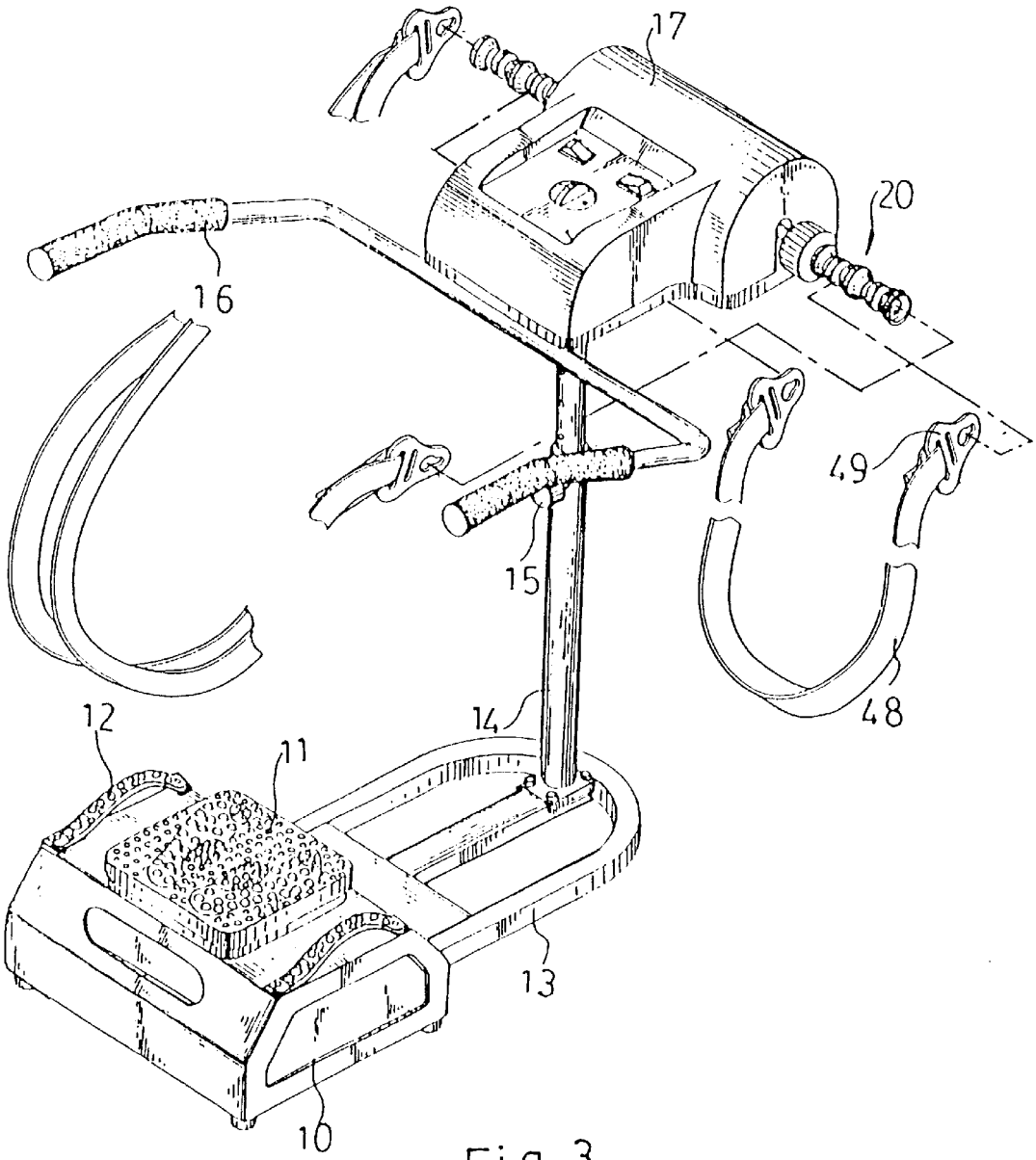
FIG. 3 is an assembled view of this invention in three dimensions.

As illustrated in FIG. 3, a multi-stage bi-directional breath flow and blood circulation aider of this invention mainly comprises: a machine casing 10; a motor (not shown) installed in the casing 10; a massage pad 11 placed on the casing 10 and a handrail 12 disposed on both sides of the massage pad 11 respectively for being driven to vibrate by the motor; one lateral end of the casing 10 being extended to form an extension seat 13 which is provided with a stretchable upright pipe 14; an adjustment knob 15 attached to the upright pipe 14 for adjusting height thereof; a pair of handgrips 16 and a control box 17 arranged at a top end of the upright pipe 14; and a rotational member 20 disposed on two sides of the control box 17 individually.

Figure 4:
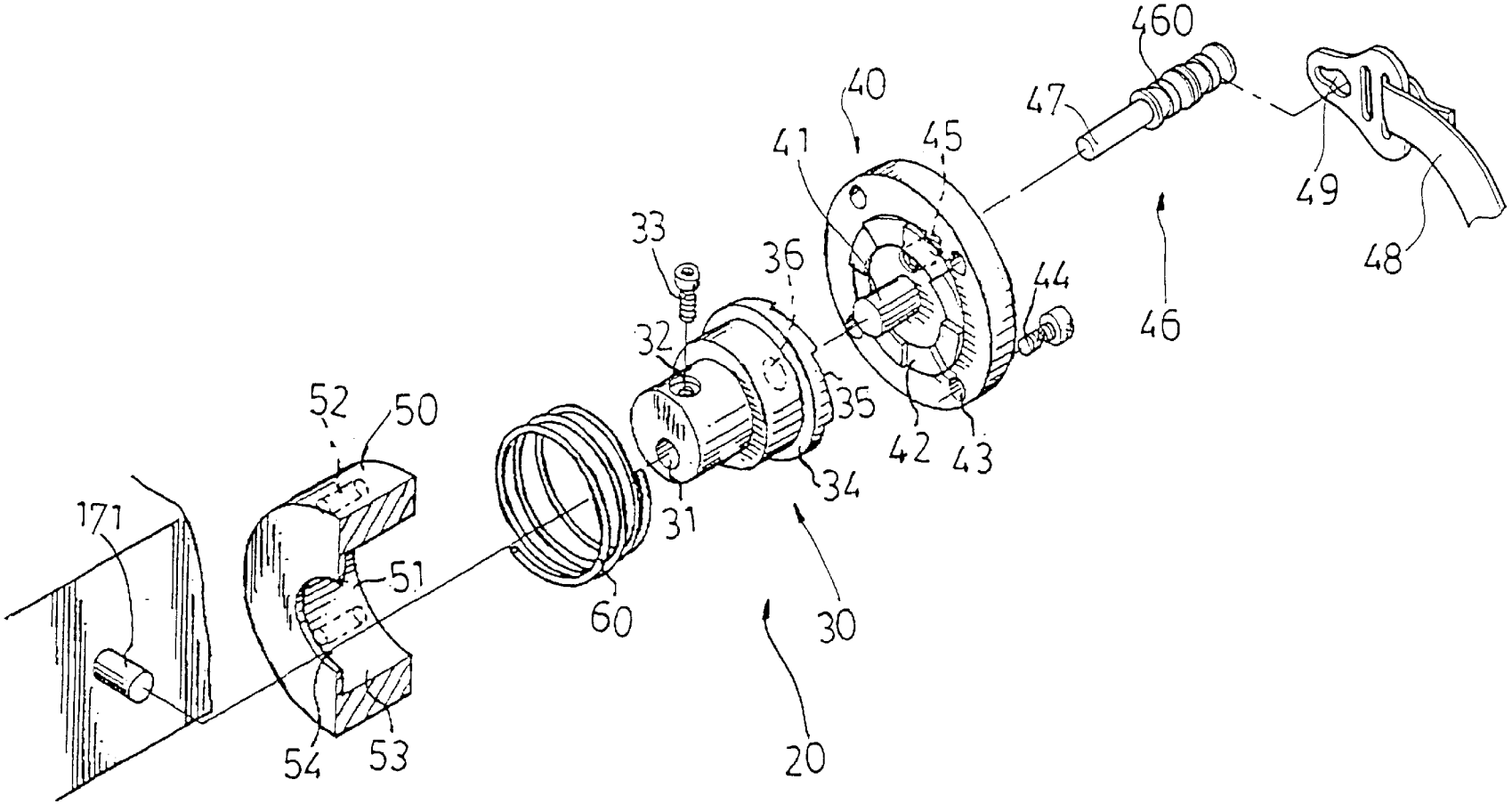
FIG. 4 is an exploded view of a rotational portion of this invention.

The rotational member 20 further comprises a positioning seat 30, an adapter 40, a closure 50, and a spring 60 as shown in FIG. 4. The positioning seat 30 is substantially a cylinder including: a shaft hole 31 in one end for jointing with a pivot shaft 171; a screw hole 32 in a lateral face for locking a bolt 33 to prop tightly against the pivot shaft 171; a circular flange 34 on one end; and a plurality of ratchet teeth 35 annularly aligned on the other end which is also provided with a central cavity 36.

The adapter 40 is substantially a disk comprising: a central shaft 41 and a plurality of circularly distributed ratchet teeth 42 at an end face; a plurality of through holes 43 perforated adjacent to the rim of the adapter 40 for penetratingly fixing a plurality of bolts 44; a positioning hole 45 disposed eccentrically at the other end for fixing an eccentric rod 46; a shaft 47 provided with a plurality of recessed grooves 460 just same as that in a conventional gymnastic equipment and setting two fixed rings 49 of a belt 48 on the recessed grooves 460.

The closure 50 is a circular body having an opening 51 and a plurality of screw holes 52 at one end, a central hole 54 at the other, and an inside storage space 53 for accommodating a spring 60.

Figure 5:
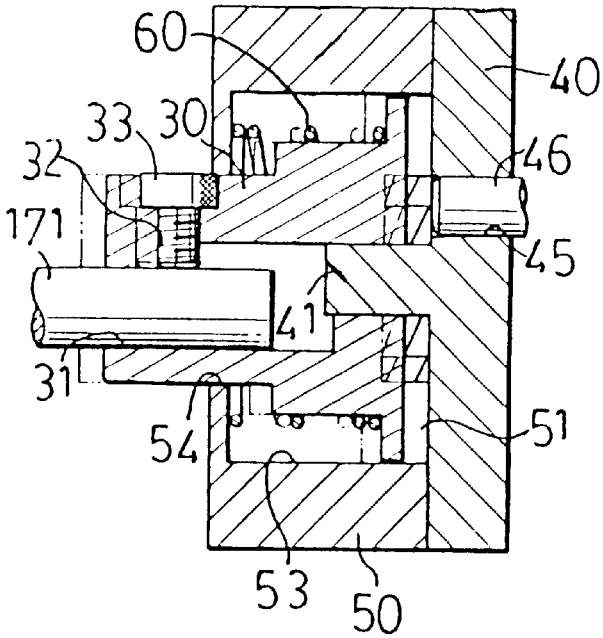
FIG. 5 is a partially cutaway sectional view of an assembled gymnastic equipment of this invention.
Figure 6:
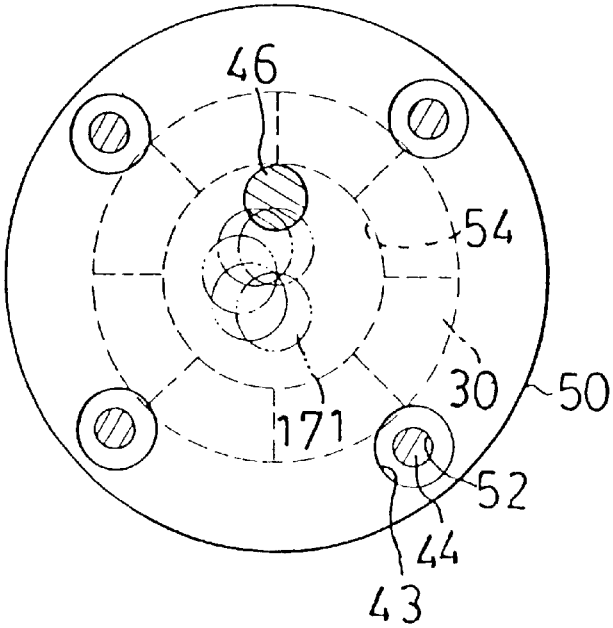
FIG. 6 is a schematic view showing relative rotation between a matched seat and a positioning seat of this invention.
Figure 7:
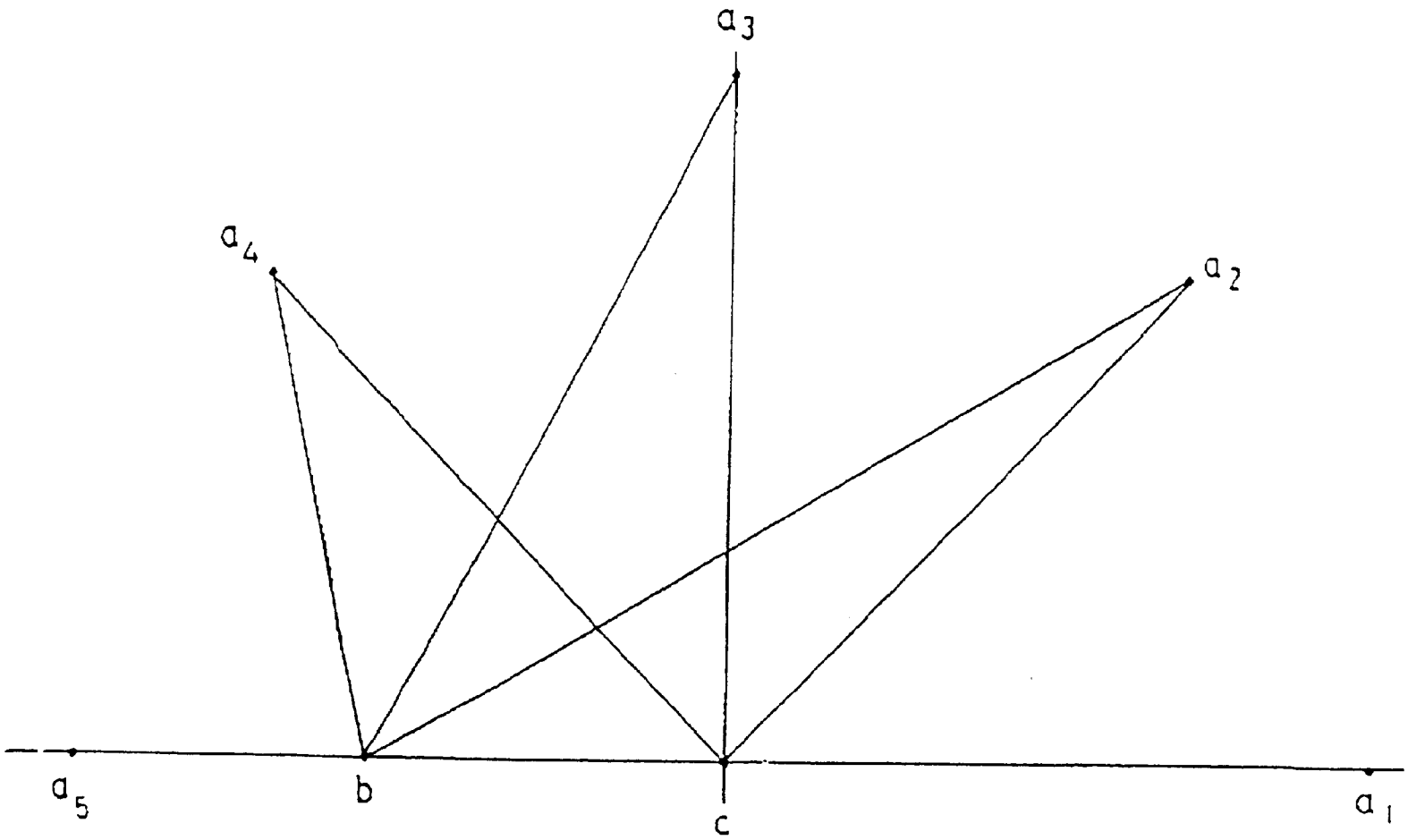
FIG. 7 is a plotted diagram illustrating eccentricity of an eccentric piece to a pivot shaft of this invention.

Referring to FIG. 5, the procedure for assembling this invention shall include:

collaring the spring 60 onto the positioning seat 30 to enable one end of the latter to prop against the circular flange 34;

mounting the closure 50 on the positioning seat 30 to allow one end of the latter to penetrate through the central hole 54 of the closure 50 and allow the other end of the spring 60 to prop against an inner face of the closure 50;

attaching the adapter 40 to the other end of the positioning seat 30 by having the central shaft 41 inserted in the cavity 36 of the positioning seat 30 so as to get rid of any transverse offset of the adapter 40 relative to the positioning seat 30 and having the ratchet teeth 42 engaged with the ratchet teeth 35 of the positioning seat 30;

pressing the closure 50 to joint with the adapter 40 so as to compress the spring 60 and having the screw holes 52 of the closure 50 and the through holes 43 of the adapter 40 aligned on a line and fixed with the bolts 44 to unify the closure 50 and the adapter 40 to thus put the inside positioning seat 30 under a unidirectional rotatable state;

collaring the shaft hole 31 of the positioning seat 30 on the pivot shaft 171 of the control box 17 and having the bolt 33 locked in the screw hole 32 and propped tightly against the pivot shaft 171; and locking the eccentric rod 46 to the positioning hole 45 of the adapter 40 and buckling the fixed rings 49 of two jointedly disposed belts 48 around the recessed grooves 460 of the shaft 47 to have the job done.

As shown in FIGS. 4, 5, 6, 7, and 8, in using this invention, a user is supposed to hitch the belts 48 on his body, then start the electric motor in the casing 10 to drive the positioning seat 30 to rotate via the pivot shaft 171. At this moment, as one end of the spring 60 is propping tightly against the circular flange 34 of the positioning seat 30 and the other propping against the closure 50, thus the adapter 40 and the closure 50 both are driven to rotate following the positioning seat 30 because of the firm engagement of the ratchet teeth 42 of the adapter 40 with the ratchet teeth 35 of the positioning seat 30.

Figure 8:
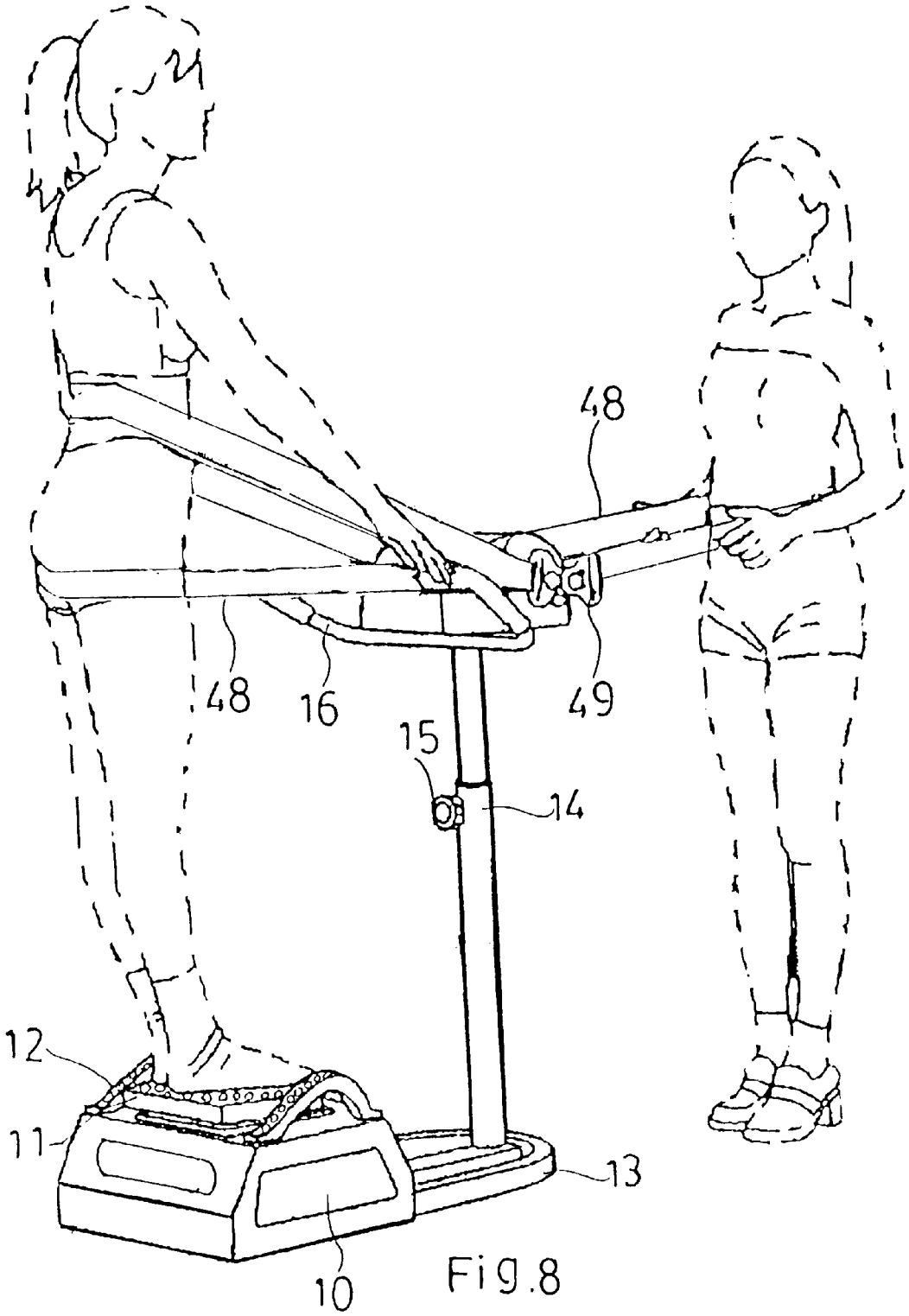
FIG. 8 shows this invention under operation.

Now, basing on the eccentricity between the eccentric rod 46 and the pivot shaft 171, the eccentric rod 46 rotates eccentrically to enable the belts 48 to pull and release back and forth intermittently as shown in FIG. 8. In case change of physical energy consumption is desired, a user may shut down the power to stop rotation of the positioning seat 30, then turn the adapter 40 for speed adjustment, wherein the turning angle is divided into 4 stages of tooth clearance including one, two, three, or four pieces of ratchet tooth 42. For example, there are totally eight pieces of ratchet tooth 42 in this invention distributed in two symmetrical portions, thus adjustment could be made from 0 all the way up to 4 for 5-step speed control. Cross-reference is made to FIGS. 5 and 7, which reveal that the eccentricity between the eccentric rod 46 and the pivot shaft 171 is minimized to the least (5 mm approx.) and so is the physical energy consumption (the fifth speed) when center of the eccentric rod 46 (a5), of the pivot shaft 171 (b), and of the positioning seat 30 (c) are aligned on a line if, and only if, (a5) and (b) are located on the same side of (c). And when the adapter 40 is turned to override one piece, two pieces, and so forth up to four pieces of the ratchet tooth 42 stepwise, the correspondent eccentricity is changed through 6.5 mm (the fourth speed), 10.3 mm (the third speed), 13.1 mm (the second speed) all the way to 14 mm (the first speed) in 5-step physical energy consumption adjustments.

According to the abovesaid, the merits of this invention may be summarized as the following:

1. A multi-stage speed variable structure is made by disposing the ratchet teeth 35, 42 at one end of the positioning seat 30 and of the adapter 40 respectively to enable a user to adjust physical energy consumption.
2. A simple structure is presented by covering the closure 50 and the adapter 40 on respective ends of the positioning seat 30, with the inside spring 60 propping tightly against the closure 50 and the positioning seat 30 to have the ratchet teeth 35 meshed with the ratchet teeth 42 for easy adjustment of speed.

In the above described, at least one preferred embodiment has been elucidated with reference to drawings annexed, it is apparent that numerous variations or modifications may be made without departing from the true spirit and scope thereof, as set forth in the claims below.

What is claimed is:

1. A multi-stage bidirectional breath flow and blood circulation aider, comprising:

a machine casing having a massage pad, a handrail, an extension seat, a stretchable upright pipe, an adjustment knob, a pair of handgrips, and a control box; a rotational member is disposed on two sides of the control box respectively; a motor is installed in the machine, casing interacting with a pivot shaft having one end jointed with a positioning seat of the rotational member; and an eccentric rod is indirectly jointed to the positioning seat for disposing two belts so that the positioning seat will rotate to drive the eccentric rod to revolve eccentrically for pulling and releasing the belts reciprocally and for purpose of physical gymnastic exercise; wherein:

a plurality of ratchet teeth is annularly aligned on one end face of the positioning seat; an adapter is attached to said end face of the positioning seat; a plurality of ratchet teeth is arranged on an end face of the adapter to allow engagement of the ratchet teeth on the adapter with the ratchet teeth on the positioning seat; the positioning seat is provided with a lateral flange and collared with a spring on a laterally extended portion to have one end of the spring propped against the lateral flange; a closure for uniting together with the adapter to form a unitary body is placed laterally to cover the positioning seat; and the other end of the spring is propping against an inner lateral wall of the closure, and one end of the positioning seat penetrates and protrudes the closure to joint with the pivot shaft while the eccentric rod is disposed in another end face of the adapter to revolve eccentrically when the motor is started.

2. The circulation aider according to claim 1, wherein a central cavity is formed in the positioning seat in the end face having the ratchet teeth, and a central shaft extended from the end face of the adapter provided with the ratchet teeth is plugged in the central cavity.

* * * * *